United States Patent [19]

Wilson

[11] 3,958,853

[45] May 25, 1976

[54] CONNECTOR

[75] Inventor: Robert Everett Wilson, Agoura, Calif.

[73] Assignee: Viking Industries, Inc., Chatsworth, Calif.

[22] Filed: Dec. 12, 1974

[21] Appl. No.: 531,924

[52] U.S. Cl. ..... 339/99 R; 29/203 MW; 339/209

[51] Int. Cl.[2] ..... H01R 13/38

[58] Field of Search ..... 339/97–99, 339/206–210; 29/203 MW, 203 HT:203 DT

[56] References Cited

UNITED STATES PATENTS

| | | | |
|---|---|---|---|
| 2,450,050 | 9/1948 | Macy | 339/210 M |
| 3,162,501 | 12/1964 | Wahl | 339/98 |
| 3,414,867 | 12/1968 | Travis | 339/99 R |
| 3,496,522 | 2/1970 | Ellis, Jr. et al. | 339/99 R |
| 3,511,921 | 5/1970 | Pasternak | 339/98 |
| 3,599,172 | 8/1971 | Tuchto | 339/98 |
| 3,617,983 | 11/1971 | Patton | 339/98 |
| 3,708,779 | 1/1973 | Enright et al. | 339/99 R |
| 3,777,299 | 12/1973 | Mikerson | 339/176 MP |
| 3,808,582 | 4/1974 | Aldridge | 339/99 R |
| 3,816,818 | 6/1974 | Meier | 339/99 R |
| 3,824,527 | 7/1974 | Evans | 339/97 R |
| 3,824,530 | 7/1974 | Roberts et al. | 339/99 R |
| 3,860,318 | 1/1975 | Reavis, Jr. et al. | 339/99 R |

*Primary Examiner*—Joseph H. McGlynn
*Attorney, Agent, or Firm*—Lindenberg, Freilich, Wasserman, Rosen & Fernandez

[57] ABSTRACT

The application describes an electrical connector of the type which has a row of contact elements with mating ends and with upstanding slotted rearward ends that receive and pierce insulated wires, including a carrier of insulative material for installing and retaining the wires in the contact elements. The carrier is an elongated trough-shaped member with a pair of side walls that can fit respectively forward and rearward of the upstanding slotted contact portions, the side carrier walls having grooves which receive the insulated wires so that when the carrier is pressed against the connector the carrier forces the wires into the slots of the contact elements. The carrier has a resilient hook at either end which engages recesses formed in the connector frame as the carrier is pressed thereagainst.

6 Claims, 16 Drawing Figures

Fig. 2
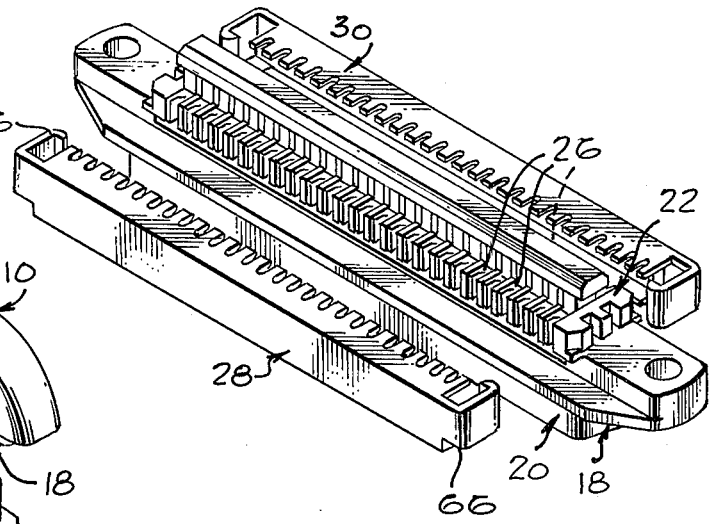
Fig. 1
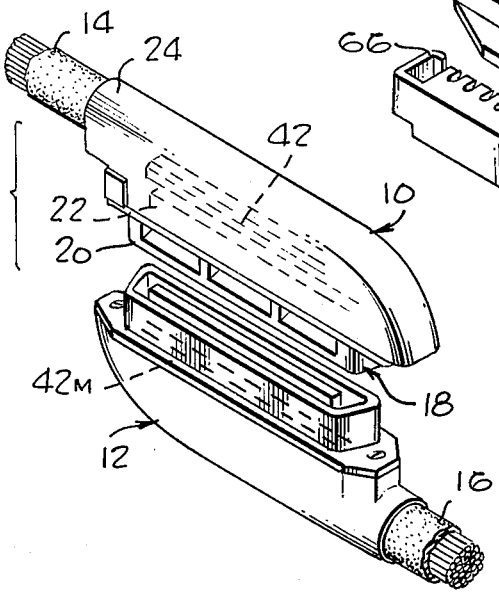
Fig. 3
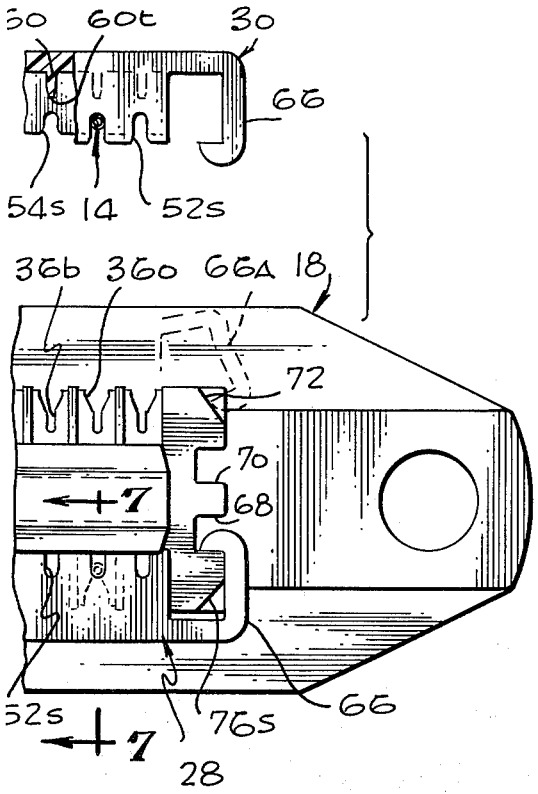
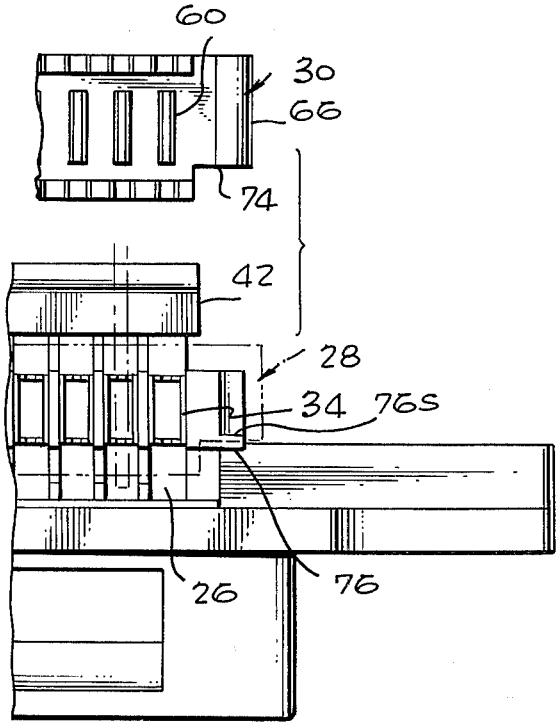
Fig. 4

Fig. 5
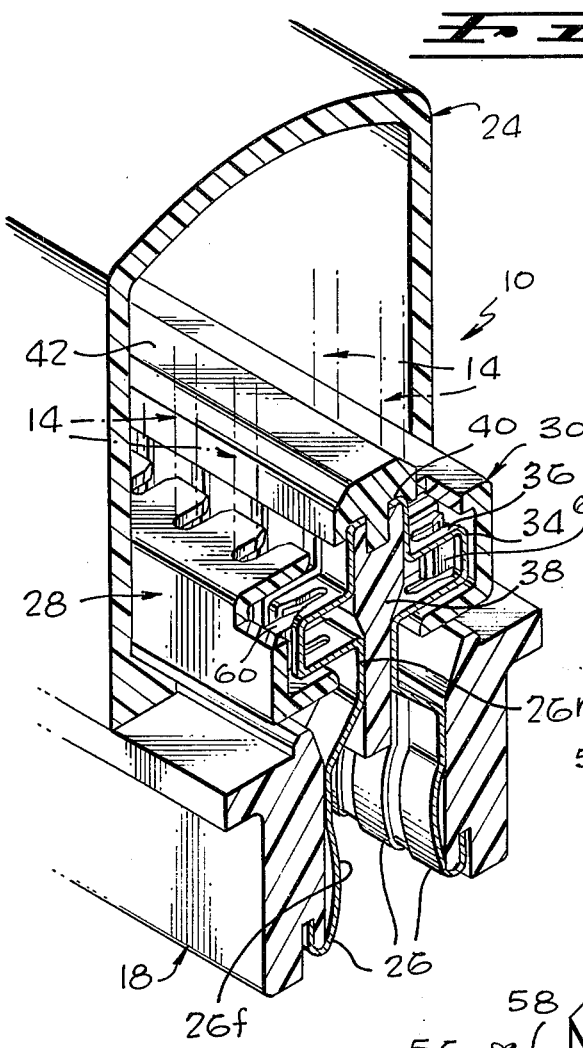
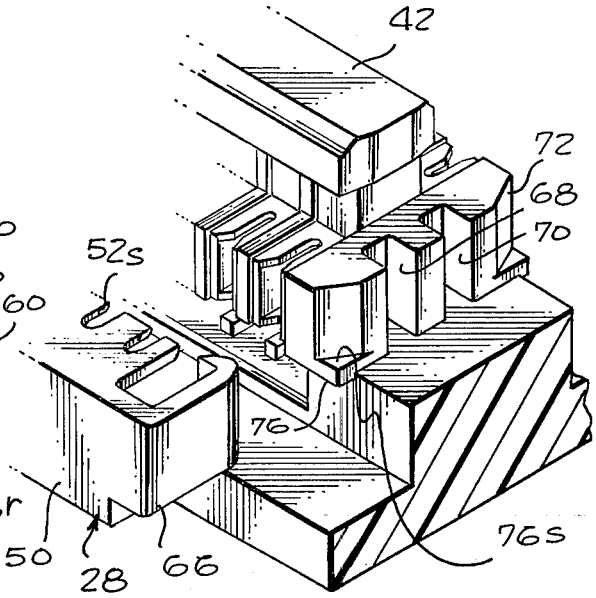
Fig. 6
Fig. 7
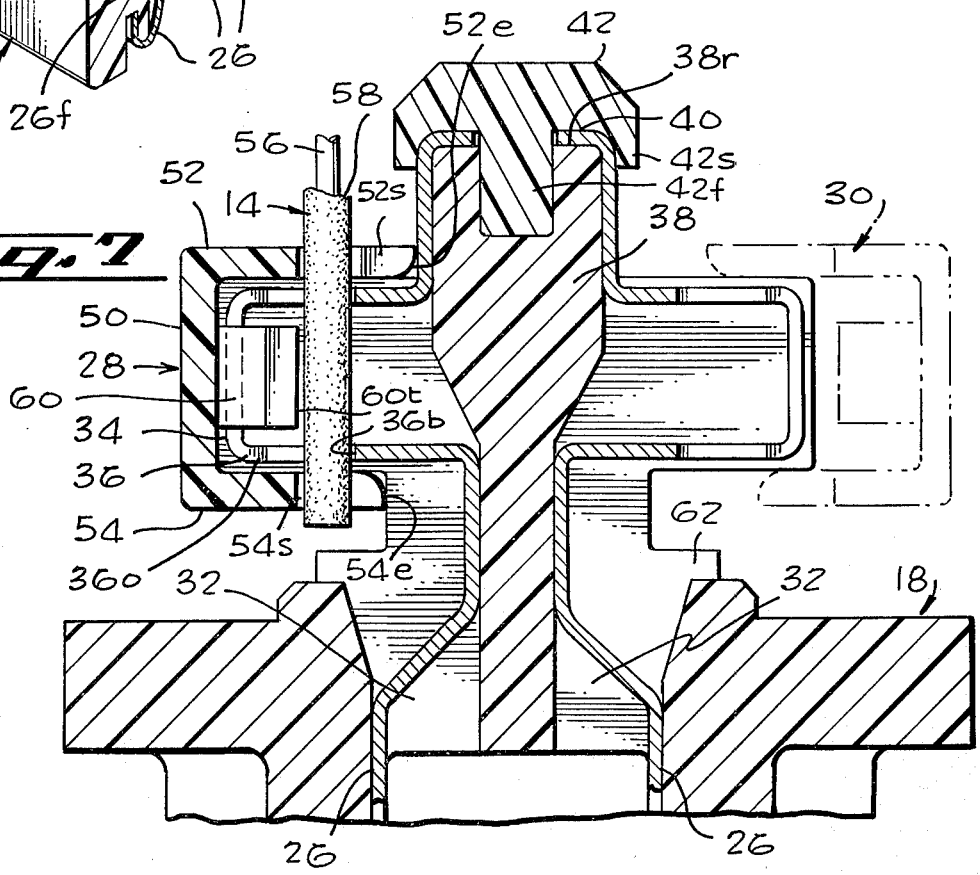

Fig. 8
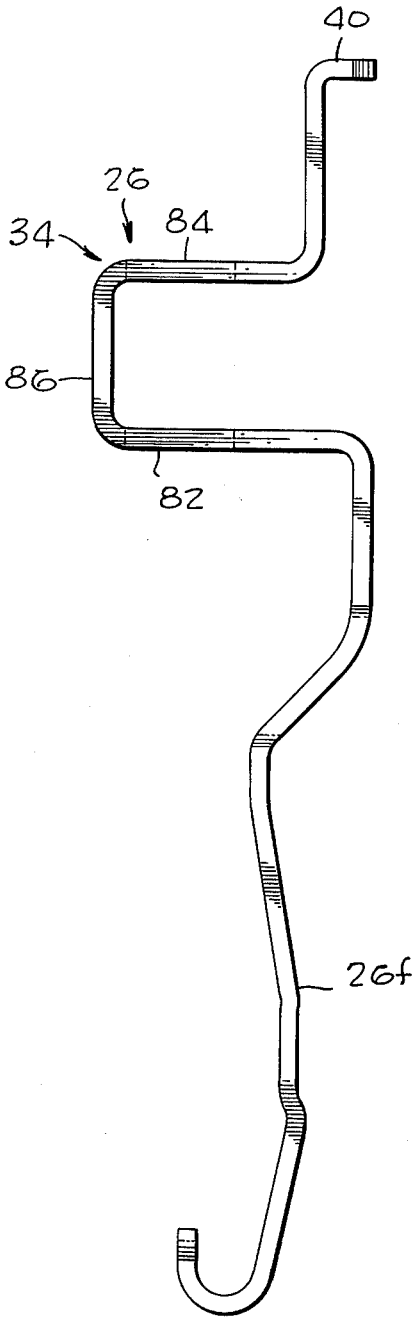
Fig. 10
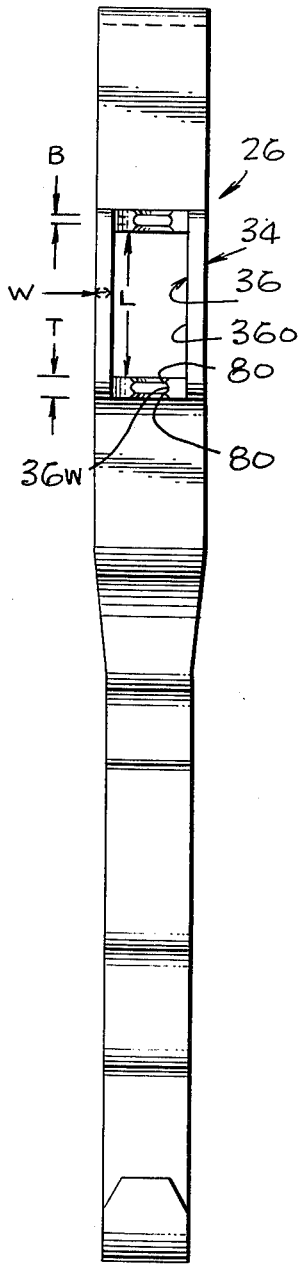
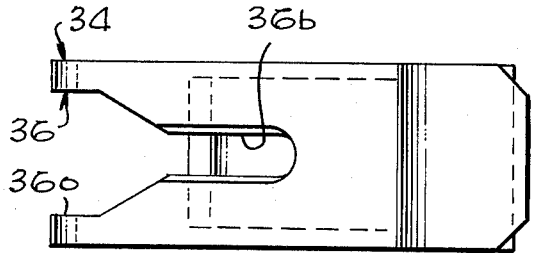
Fig. 9

CONNECTOR

BACKGROUND OF THE INVENTION

This invention relates to electrical connectors.

One type of electrical connector used in telephone installations includes a frame having two rows of contact elements with the rear end of the elements connected to insulated wires. The connection of the wires to the contact elements is most commonly performed in a factory by stripping the wire ends and soldering them to the contact elements. Another type of wire installation which is especially useful in field repairs, involves the use of contact elements with slotted upstanding rearward portions which can pierce the insulation of a wire as it is pressed into the slot, to thereby eliminate the need for stripping the wire or soldering it to the contact element. The wires can be attached by first installing them in the grooves of a special jig, locating the jig adjacent to the contact elements, and then transferring the wires from the jig to force the wires into the slots of the contact elements. Afterwards, a hood can be placed over the entire rear portion of the connector frame to protect the wires.

The use of insulation-piercing in the installation of wires can result in several disadvantages. One disadvantage is that the wires may move sidewardly out of the slotted contact elements or may break off where the contact elements pierce the insulation. The bundle of wires extending from the connector can be clamped to minimize the possibility of straining the wires, but damage may occur prior to full clamping. In field installation, errors sometime occur in installing a pair of wires in the wrong contact elements. While the wire can be readily pulled out of a slotted contact element, it is difficult to reliably reinstall the wires in the correct contact elements without special tools. An electrical connector of the insulation-piercing type which simplified initial installation and assured secure retention of the wires on the contact elements, but which also permitted rapid removal of a pair of wires and reliable reinstallation without special tools, would greatly aid in field repairs.

SUMMARY OF THE INVENTION

In accordance with one embodiment of the present invention, an electrical connector is provided which enables the rapid installation of wires on the contact elements of a connector, and which provides secure retention, protection, and strain relief of the wires while also facilitating intentional removal and reinsertion of a pair of wires. The connector includes a frame with a central rear wall having a row of recesses on either side that hold two rows of contact elements. The contact elements have rear upstanding portions which are slotted to receive and pierce the insulation of wires. A pair of carriers constructed of insulative material and attached to the connector frame, are disposed over each row of upstanding contact element portions. Each carrier has a row of slots or grooves which hold the insulated wires at locations near the positions where the wires are pierced by the contact elements. The carriers not only prevent the wires from moving out of the slots of the contact elememts, but also provide strain relief to prevent breakage of the wires at their pierced locations. The carriers are releasably held to the frame by resilient hooks, the hooks being releasable to permit a pair of wires on the wrong contact elements to be switched to the correct elements, the carrier then being useful in reinstalling the wires on the contacts without special tools.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a pair of matable electrical connectors, shown prior to mating;

FIG. 2 is a rear perspective and exploded partial view of one of the connectors of FIG. 1, showing the overall shape of the frame and carriers thereof;

FIG. 3 is a rear view of a portion of the connector shown in FIG. 2, with one of the carriers installed and the other shown prior to installation;

FIG. 4 is a partial side elevation view of the carrier of FIG. 3, with one carrier shown prior to installation and the other shown in phantom lines at its installation position;

FIG. 5 is a partial perspective view of the connector of FIG. 2;

FIG. 6 is a partial perspective view of the carrier of FIG. 2;

FIG. 7 is a view taken on the line 7—7 of FIG. 3;

FIG. 8 is a greatly enlarged partial elevation view of the contact element of FIG. 7;

FIG. 9 is a rear elevation view of the contact element of FIG. 8;

FIG. 10 is a side elevation view of the contact element of FIG. 8;

DESCRIPTION OF THE PREFERRED EMBODIMENTS

Figure 11:
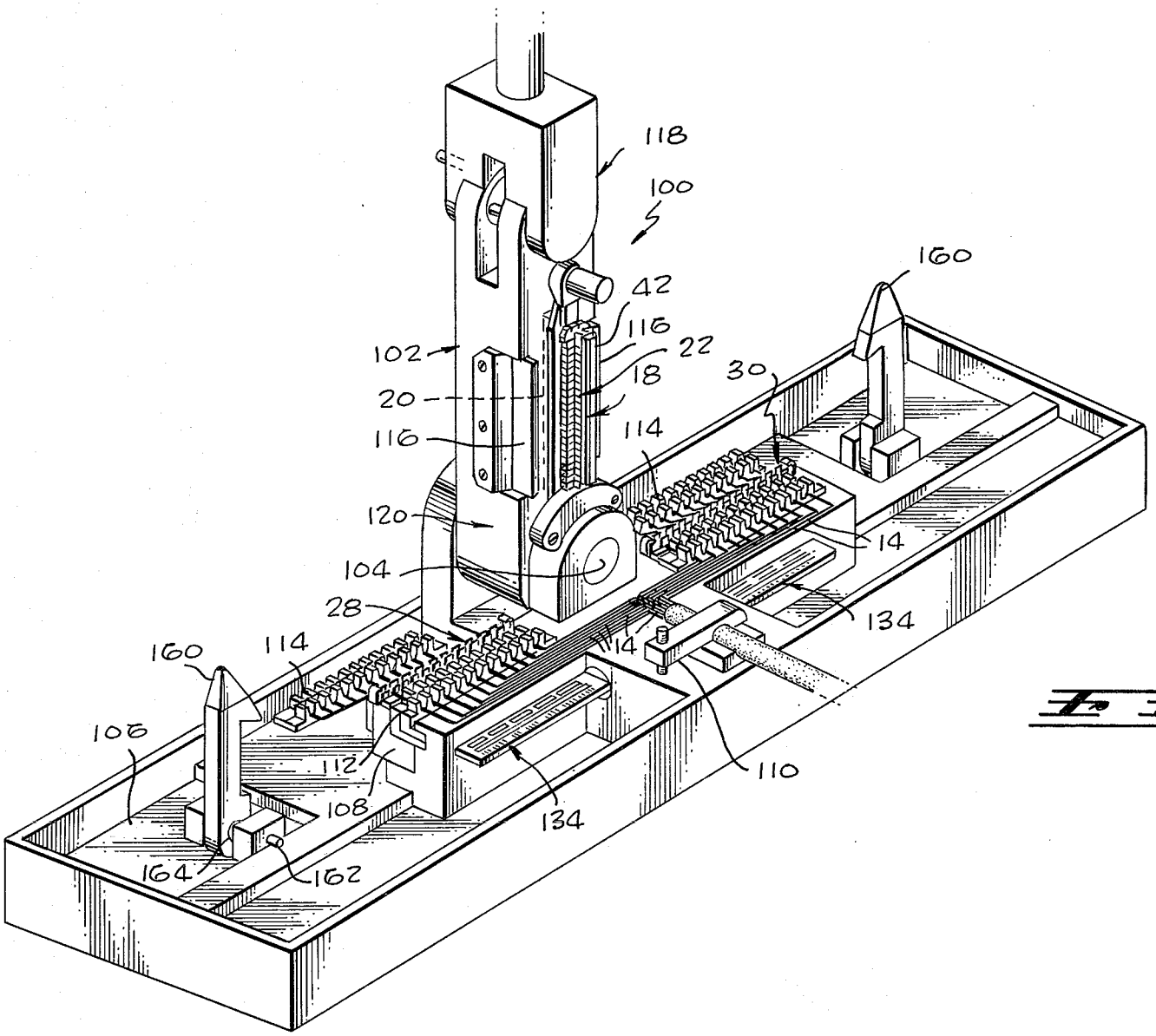
FIG. 11 is a perspective view of an installation tool utilized with the connector of FIG. 5, shown at the beginning of the installation process.

FIG. 1 illustrates a connector assembly which includes a female connector 10 and a male connector 12, which can be mated to interconnect two bundles of wires 14, 16. The female connector 10 includes a frame 18 with a forward or mating portion 20 which is exposed prior to mating of the connectors, and a rearward portion 22 which is covered by a hood 24. As shown in FIG. 2, the rearward portion 22 of the frame holds two rows of electrical contact elements 26 which make electrical connection with the wires of the wire bundle 14 and which also can make mating contact with corresponding contacts of the male connector. A pair of carriers or retainers 28, 30 are designed for installation on the rear portion 22 of the connector frame to aid in the installation of the wires on the contact elements 26, and to hold and protect the wires after they are installed on the contact elements.

As best shown in FIG. 5, the connector frame 18 has two rows of recesses 32 which hold the two rows of contact elements 26 in position. Each contact element 26 has a front or mating end 26*f* designed to engage elements of another connector, and a rearward end 26*r* which is designed to contact the conductor of an insulated wire 14. The rearward end 26*r* of the element has an upstanding portion 34, which has a slot 36 extending therein that is designed to receive and pierce an insulated wire 14. The rearward ends 26*r* of the contact lie against a central rear wall 38 of the connector, with the rearward tips 40 of the contact elements being bent around the central wall to lie on the rearward surface 38*r* of the central rear wall. The rearward tips 40 are securely retained in place by a cap 42 which has a central projection or flange 42*f* received in a corresponding groove at the center of the rearward wall surface 38*r;* the cap flange may be heat welded or otherwise fixed in place in the groove. The cap has a pair of overhanging lips or sides 42*s* which extend around the bent tips 40 of the contact elements to securely hold them in place, and to prevent prying away of a contact element if a wire is pulled out of the element.

In accordance with the present invention, the wires 14 which are received in the contact element slots 36, are securely and protectively retained by the pair of carriers 28, 30. Also shown in FIG. 7, each carrier, such as 28, is an elongated trough-shaped member with a base wall 50 spaced from the central rear wall 38 of the frame, and with rearward and forward carrier side walls 52, 54 which lie respectively rearward and forward of the upstanding contact element portion 34. The rearward carrier wall 52 has a row of slots or grooves 52*s* that are designed to receive the wire 14, while the forward carrier wall 54 has a corresponding row of slots or grooves 54*s* that also can receive the wires. The slots 52*s* and 54*s* are slightly narrower than the wire 14 to provide an interference fit therewith. A wire 14 which has a central core or conductor 56 surrounded by insulation 58, is generally installed by first installing the wire on the carrier 28 so that the wire extends through a groove 52*s* of the rearward wall and a groove 54*s* of the forward wall of the carrier. The carrier 38 is then pressed towards the connector frame, with the grooves 52*s*, 54*s* in the carrier positioned in line with the slot 36 in the contact element 34. The carrier thus forces the wire 14 to enter the slot in the contact element. The outermost portion 36*o* of the slot is wide enough to readily receive and guide the wire into the slot while the deepest or bottommost portion 36*b* of the slot is narrow enough to cut through the insulation of the wire and make contact with the central conductor 56 of the wire. In order to support the wire portion lying between the two walls 52, 54 of the carrier, particularly during installation into the contact element, the carrier is also provided with a row of supports 60 that can help to press the wire into the contact element slot. Each support has a tip 60*t* which is narrower than the outer portion 36*o* of the contact element slots, and the tip 60*t* extends substantially no further from the carrier base wall 50 than the deepest locations or bottoms of the carrier slots.

After the carrier has pressed a row of wires into corresponding contact elements, the carrier is allowed to remain in place on the connector frame to become part of the connector. The carrier 28 is constructed of dielectric, or electrically insulative, material so that it cannot short-circuit the contact elements. The carrier protects the wires 14 by preventing them from falling out of the slots in the contact elements, and also by providing strain relief. Strain relief is especially valuable because the portion of the wire immediately forward of the rear carrier wall 52 has been weakened by reason of the fact that the contact element has cut through the insulation and slightly into the central conductor of the wire. In the absence of the carrier 28 or the like to provide strain relief, any sideward pulling on the wire 14 would pull the wire against the sharp walls of the slot 36, which could cause breakage. Of course, the bundle of wires is normally clamped to the hood 24 as it passes out of the connector to provide strain relief, but some wire manipulation and pulling often occurs prior to the final clamping of the bundle of wires to the hood. The carrier 28 automatically provides strain relief at a time immediately after the wire is pierced. The fully installed carrier 28 preferably is positioned so that the tip 52*e* of its upper wall bears against the contact element 26 while the tip 54*e* of its bottom wall presses against an upstanding spacer 62 of the usual type formed in a connector frame. The carrier is therefore restrained against even slight movement, so that it helps to reliably keep the wire in place in the contact element.

As illustrated in FIGS. 2–4 and 6, the carrier is formed with resilient fingers 66 at either end, that serves as retention means for holding the carrier securely to the frame 18. The portion of the frame at either end of the central wall 38 has a pair of longitudinally extending recesses 68, 70 (FIG. 3) for receiving the ends of the hooks 66 to retain the carriers on the frame. The hooks 66 interlock with the walls of the recesses 66 or 70, to prevent removal of merely pulling out the carrier. The carriers can be attached by merely pressing them against the frame so that the hooks first deflect against beveled surfaces 72 on the frame, as shown at 66A in FIG. 3, and then snap into a corresponding hook-receiving recess 68 or 70 that lie inward of the beveled surface. In order to prevent installation of the carrier in an upside-down position, the carrier is provided with a cut-away region 74 beneath (or at the forward side) of each hook, and the frame is provided with a barrier 76 that fits into the cutaway region 74. A workman tends to position the hooks directly on the rearward surface 76*s* of the barrier during any hand installation, and therefore the barriers help to encourage installation of the carriers at the proper level at which the rearward and forward walls 52, 54 fit on either side (behind and in front of) of the upstanding contact element portion 34.

The most common telephone-type connector has 50 contact elements with 25 of them positioned in each row. It is possible to initially install 25 wires on the contact element without the aid of the carriers 28, 30, and with the carriers being later attached for the purpose of retaining and protecting the already installed wires. However, the easiest and fastest installation can be accomplished through the use of a special installation tool, to be described below, which forces a carrier that is holding 25 wires in its slots against a row of contact elements to install the wires on the contact elements and to install the carrier on the frame.

Occasionally, a repairman will find that a pair of wires have been installed on the wrong contact elements, and therefore the positions of the wires must be interchanged on the contact elements. This can be readily accomplished without special tools, by removing the carrier, interchanging the wire positions, and reinstalling the carrier. Removal of the carrier is easily accomplished by merely applying one's fingernail to a hook 66 to deflect it outwardly so the corresponding end of the carrier can be pulled out, the other end of the carrier being similarly removed.

After the carrier is removed, the wires can be simply pulled out of the contact elements, and can be pushed with one's fingernail into the slot of the proper contact element or can be laid in the proper grooves of the carrier for reinstallation along with the carrier. The carrier can be reinstalled by merely pressing both ends against the frame until the hooks of the carrier snap into position. Even such manually installed wires will operate reliably because the carrier insures full insertion of the wires in the slots and assures their reliable retention. It may be noted that the grooves 52*s*, 54*s* in the carrier normally provide a slight interference fit with the wires 14 (but without cutting into the insulation), to hold the wires in place prior to installation of the carrier and wires on the frame and contact elements.

The upstanding portion 34 of the contact element, which is shown in detail in FIGS. 8–10, is designed to provide good multiple-point contact with the central conductor of an insulated wire. The edges of the slot wall at the outer portion 36*o* of the slot are preferably left flat or even convey so that they do not snap on the insulation. The bottom portion 36*b*, however, is designed not only to cut in a clean manner into the insulation, but also to slightly indent into the central conductor to establish a low resistance connection therewith. To this end, the edge of the bottom portion 36*b* is tapered as from an initial thickness T (FIG. 10) of 0.007 inch to a minimum thickness B of about half that amount. In a phosphor bronze contact element, a thickness T of 0.010 inch and thickness B of 0.005 inch was utilized, while in a beryllium copper element, a thickness T of 0.007 inch and thickness B of 0.0035 inch was utilized. A range of T from 0.010 to 0.006 inch and a range of B from 0.007 to 0.003 is usually desirable for illustrated type of contact element when used in a telephone-type connector of the illustrated type.

In addition to tapering the thickness of the contact element along the bottom slot portions, the wall of the slot portion, shown at 36*w* in FIG. 10, is formed to a concave shape to provide a concave edge surface. This leaves a pair of sharp corners at 80 which can readily press a limited distance into the central conductor of the wire to establish low resistance contact therewith. The corners 80 cannot readily penetrate more than a very small depth into the central conductor when urged thereagainst with a moderate force, so that they cannot readily sever the conductor. The upstanding contact element portion 34, which has a pair of upstanding legs 82, 84 joined by a base 86, has eight sharp corners 80 which can contact the central conductor of the wire, with each corner 80 formed to deform into the central conductor by a small distance so as to establish a low resistance contact therewith. It may be noted that the bottom slot portions 36*b* of both legs 82, 84 are of the same width in this embodiment of the invention. It is normally not necessary to leave a wider slot in the rearward leg 84 for strain relief, because the carrier wall provides the needed strain relief. Also, the base 86 can be left long and with a width W at either side of the slot 36*o* approximately equal to the very small thickness T of the strip of metal from which the contact element is made. The narrow width W and long length L at each side of the base portion can be provided, even though this leaves the base portion 36 too weak to substantially strengthen the legs 82, 84, because sufficient protection of the wire is provided by the carrier 28. If desired, it is possible to use a simple upstanding plate with a slot in its upper end, as the upstanding portion that receives and cuts into the wire, although the illustrated contact element design provides a rearward tip 40 that can be captured to more securely retain the contact element.

INSTALLATION TOOL

FIGS. 11–16 illustrate details of an installation tool 100 which can be utilized to install a group of wires 14 on a connector frame 18 that has rows ot contact elements. The installation process is basically carried out by attaching the connector frame 18 to an installing arm 102 that pivots on an axle 104 which is mounted on a base 106, and mounting each of the carriers 28, 30 in carrier holders 108 that are positioned on the base. The bundle of wires 14 are then fixed by a clamp 110 to the base, and each of the wires is threaded through the proper slots of wire holders 112, 114 so that the wires lie in the corresponding grooves of the carriers 28, 30. The arm 102 is then pivoted down across one of the carriers 28 to press the connector frame 18 against the carrier 28, so that the carrier and wires therein are forced against the connector frame. During such downward movement, a blade 116 on the arm cuts off the wires 14 to the proper length.

Figure 12:
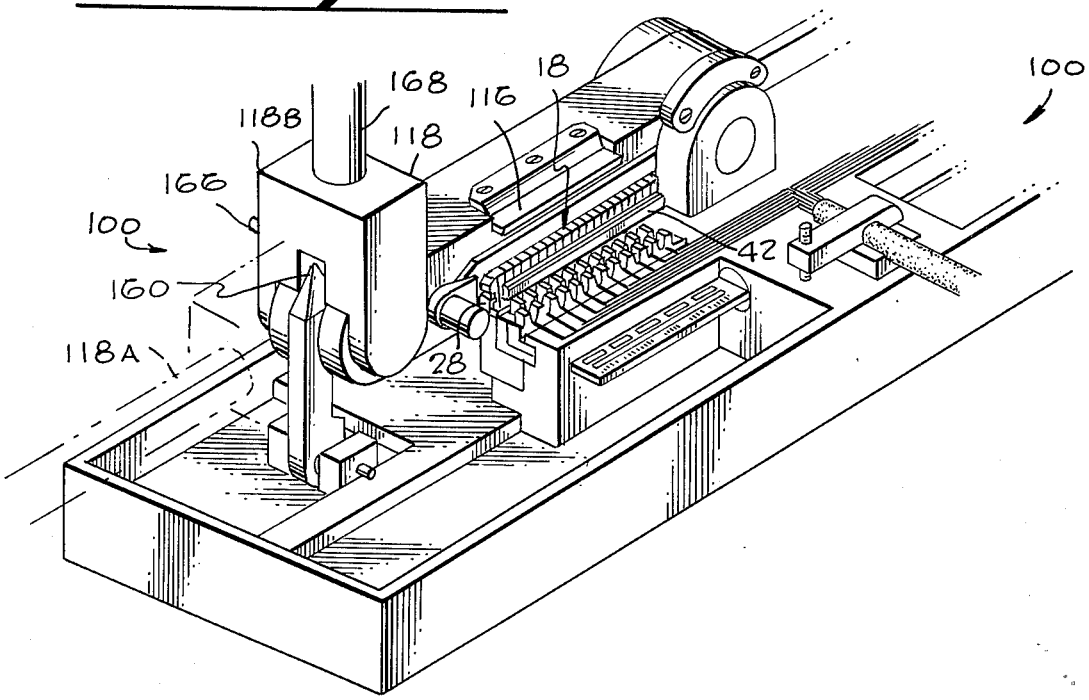
FIG. 12 is a perspective view of the tool of FIG. 11, shown at a later stage in the installation process.

At the end of the downward movement of installation arm 102, sufficient force may not have been applied all along the length of the carrier to force all 25 wires therein and the carrier into place on the connector frame. A large final installing force is applied by pivoting an upper part 118 of the installing arm with respect to a lower part 120 thereof, as shown in FIG. 12, to provide a camming action that forces the connector frame 18 hard against the carrier 28. The installing arm 102 is then lifted back to the vertical position of FIG. 11, but with the wires 14 and carrier 28 installed on the frame. Then, the arm 102 is pivoted in the opposite direction towards the other carrier 30 to cut the other wires and install them and the carrier 30 onto the connector frame. The opposite sides of the installation tool 100 which support the different carriers 28, 30 are substantially mirror-image replicas of each other.

Figure 13:
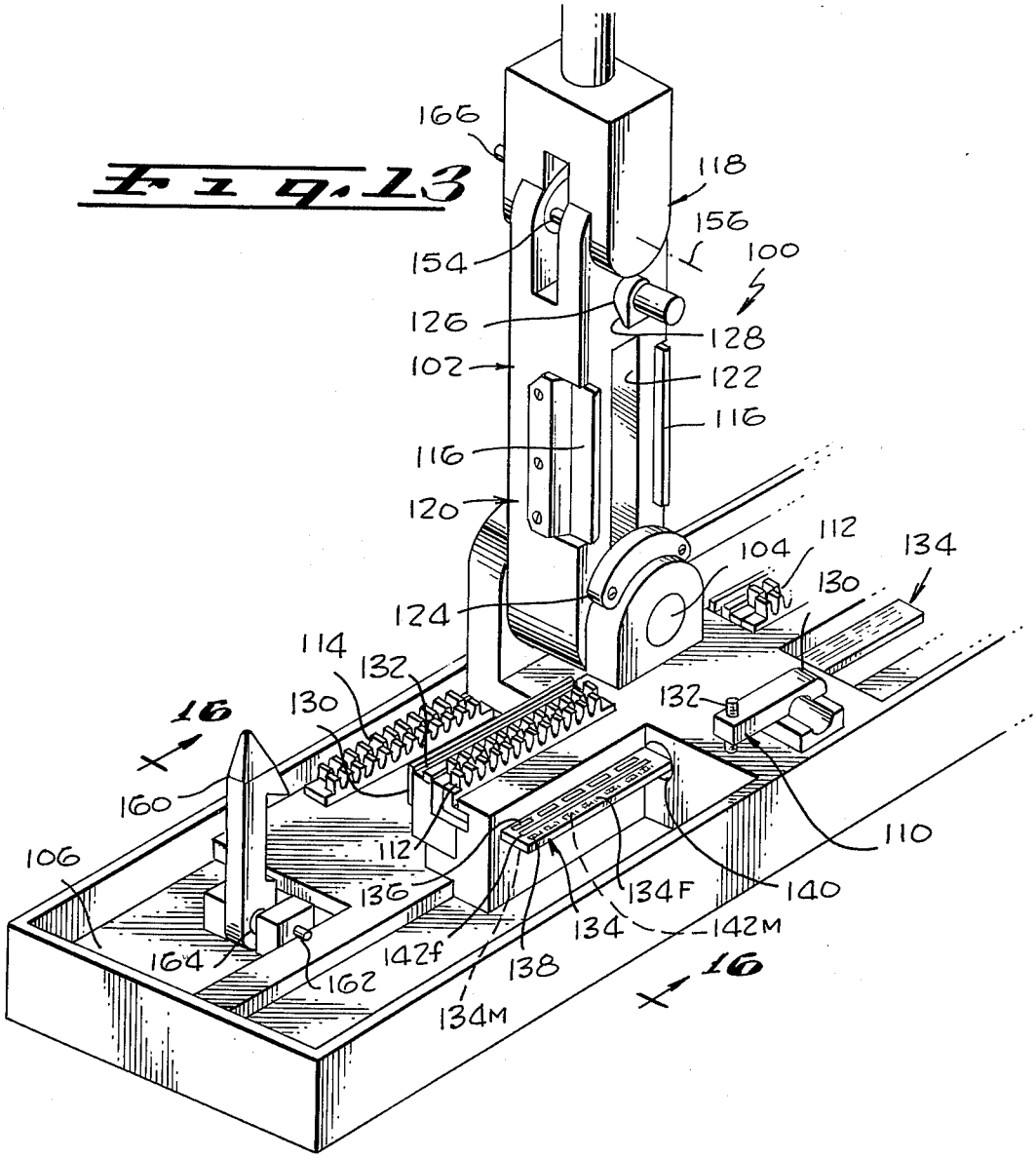
FIG. 13 is a partial perspective view of the installation tool of FIG. 11.
Figure 16:
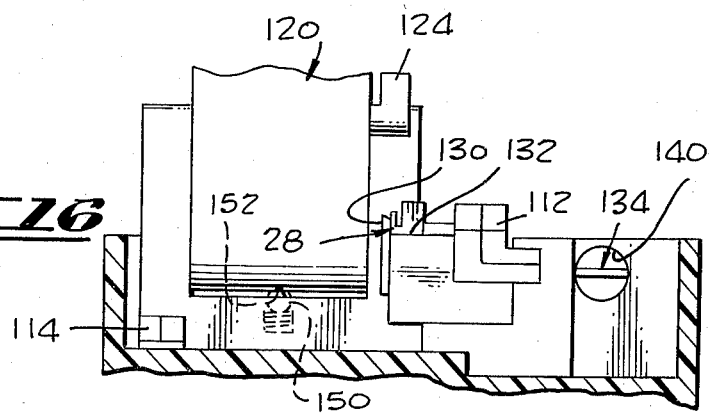
FIG. 16 is a view taken on the line 16—16 of FIG. 13.

As shown in FIG. 13, which shows details of one side of the installation tool, the arm 102 has a central recess 122 which receives the forward or mating portion 20 of the connector frame, with the rearward portion 22 projecting from the arm. The frame is inserted with one end lying behind a lower fixed member 124 and the other end lying behind a releasable upper member 126 which is spring biased towards the arm 102. The member 126 can be turned to the side for installing or removing a frame, and can be turned back so that a beveled surface 128 holds down an end of the connector frame and urges it against the lower member or stop 124. The blade 116 is designed to cut against another blade 130 which is positioned along a carrier-holding surface 132 where the carrier can be positioned, to cut the wires to length.

A cable containing many wires to be attached to the connector, may be installed on the clamp 110 by pivoting a clamp member 130 to the side about a downwardly biased pin 132 and returning the clamp member 130 to lie over the cable. The wires 14 then may be individually laced through slots of the holder 112 and through aligned grooves in the carrier and through the second holder 114. Each of the 50 wires of a typical telephone cable is normally marked by two colors, and each wire must be positioned in the proper carrier groove so it will be connected to the proper contact element of the connector. Proper installation of the wires is aided by a color chart device 134 which has chart surface or chart 134F with a lower row 136 of colors and an upper row 138 of colors. The proper grooves for each wire can be determined by positioning the wire so that it lies at a position where its two colors are the same as the two colors in the chart rows 136, 138. The chart device 134 is mounted on a rotatable holder 140 to permit it to be turned over for use with a male connector. One side of the chart device which contains the chart 134F, includes a central strip 142*f* of red color which identifies that chart as the one intended to be used for female connectors. The other side or chart 134M of the chart device has a different arrangement of colors and has a blue center strip 142*m* which identified that side as intended to be used for male connectors.

One type of mistake made in field installation of wires on a connector is the use of a wrong chart; that is, the use of a male lacing chart in the installation of wires on a female connector, or vice versa. Such an error can be easily made because the rear frame portions 22 of the male and female connectors are identical in shape and size, while the mating front connector portion 20 are hidden from view when the connectors are mounted on the installing arm. To minimize the possibility of such an error, the cap 42 on the rear wall of the female connector is formed of red plastic. The cap on a male connector (42M in FIG. 1) is correspondingly formed of blue plastic. Thus, a repairman can readily determine that the proper chart side is being displayed for the particular connector, by noting that the red cap 42 matches the red central line 142*f* on the chart. This eliminates apprehension in the repairman that he may have the wrong chart displayed, and eliminates the need for him to remove the connector and check the front frame portion. Also, the matching red cap 42 and chart line 142*f* can automatically warn the repairman if he has forgotton to turn the chart to the proper side.

Figure 15:
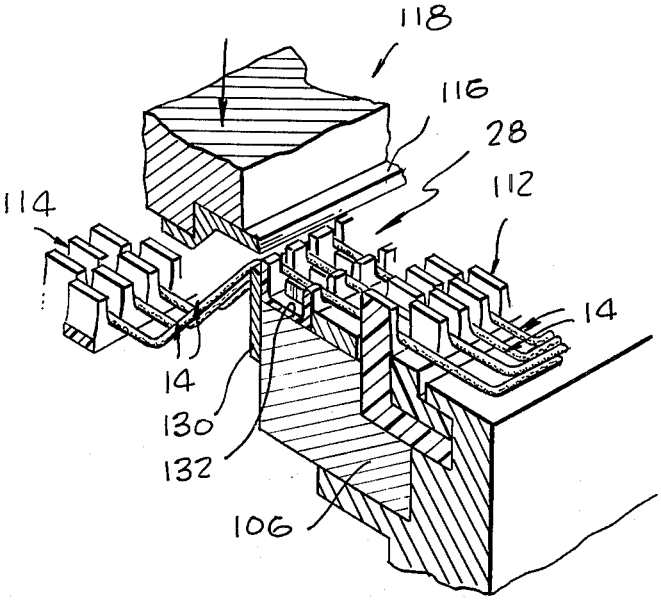
FIG. 15 is a partial perspective view of the tool of FIG. 13, shown during a stage of operation.
Figure 14:
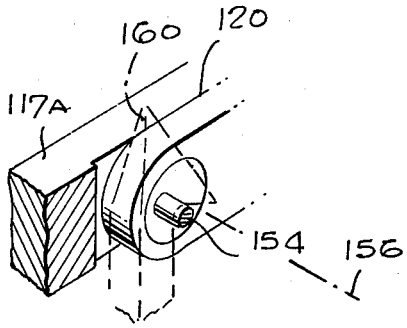
FIG. 14 is a partial perspective view of the tool of FIG. 13, shown during a stage of operation.

The installation arm 102 is retained in an upright position by an upwardly biased ball 150 (FIG. 16) that is urged into a recess 152 at the bottom of the arm. However, a person can easily force the arm to pivot to either side. As the arm pivots down, cutting of the wires is accomplished with only moderate downward force, because the wires are not all cut at the same time, but are cut one after the other as shown in FIG. 15. However, the 25 wires are not pushed into the slots of the 25 corresponding contact elements, until the arm reaches its lower position, at which time all or a large number of the wires are pressed into their corresponding contact elements at the same time. It is normally difficult for a person to press down the installation arm 102 with sufficient force to install all 25 wires at the same time. To aid in the application of a high force, the upper part 118 of the installation arm is provided with a cam 154 in the form of a rod which is mounted a distance from the axis of pivoting 156 of the upper arm part 118 on the lower arm part 120. When the arm is pivoted down until the upper part is at the position shown in phantom lines 118A in FIG. 12 and in solid lines at 118A in FIG. 14, a hook 160 hooks over the cam 154. The hook 160 is pivotally mounted on a rod 162 (FIG. 12) and is urged by a spring 164 to pivot towards the center of the tool. Thus, as the installation arm is moved down, the hook 160 is deflected by the cam 154 and then hooks over the cam as shown in FIG. 14.

After the arm 102 has been moved down so its upper part is at position 118A and the hook 160 has engaged the cam 154, the operator moves a release lever 166 that permits the upper arm part 118 to pivot with respect to the lower part 120. The operator then lifts up the upper arm part to the position shown at 118B in FIG. 12. During such lifting, the cam 154 tends to push up on the hook 160, which causes the outer end of the lower arm part 120 to press down. This camming arrangement provides high leverage, so that with only a moderate lifting force on a handle 168 of the upper arm part, the operator causes the application of a large downward force to the outer end of the lower arm part 120, to firmly press the carrier 28 and all of the wires into the corresponding contact elements on the connector frame 18. The operator then lowers the upper part 118 to a horizontal position, pivots the hook 160 out of engagement with the cam 154, and raises the entire arm 102. The arm moves up, with the carrier and wires now being pulled up with the connector frame 18 to the central position. The operator then repeats the operation at the other side of the connector, to finish the installation. The connector frame with the wires attached thereto is removed from the installation tool, a hood may be attached over the rear frame portion, and the cable or bundle of wires 14 may be clamped by the tool to the connector frame.

Thus, the invention provides an electrical connector in which the wires are retained on the contact elements in a reliable and secure manner and which provides an installation tool for easily installing the wires on the elements. The electrical connector includes wire-piercing contact elements and a carrier with grooves for holding the wires securely on the contact elements and for also serving to support the wires while they are pressed into and pierced by contact elements. The carriers are retained on the connector frame by resilient hooks that automatically engage the connector frame and which allow easy removal of the carrier and reinstallation of a limited number of wires and the carrier without special tools. The contact elements themselves are securely retained on the connector frame by a cap which is of a distinctive color identifying the connector as a male or female type to reduce the possibility of errors during the installation of the wires. The contact elements are formed with slots having concave slot wall edges that engage the central conductor of a wire to slightly penetrate the surface of the central conductor so as to establiish a reliable low resistance contact therewith. The installation tool establish an arm which can pivot to either side to cut and then begin installation of the carrier and wires of a connector frame, with the arm having two pivotally connected parts that can pivot to provide a camming action at the end of arm movement that forces the carrier against the connector frame with a high force.

Although particular embodiments of the invention have been described and illustrated herein, it is recognized that modifications and variations may readily occur to those skilled in the art and consequently, it is intended that the claims be interpreted to cover such modifications and equivalents.

I claim:

1. A connector comprising:

a frame;

a plurality of electrical contact elements mounted on said frame in a row configuration thereon, each of said elements having an upstanding wire-receiving portion with a slot for receiving an insulated wire and cutting through the insulation to contact the core of the wire;

a carrier of insulative material having a row of slots for receiving the insulated wires, said carrier having retention means for holding the carrier to said frame with said slots in said carrier being aligned with said slots in said contact elements; and a plurality of insulated wires disposed in said slots of said carrier, said slots of said carrier being slightly narrower than said wires so that the wires are held in an interference fit therein.

2. A connector for making connection to an insulated wire of predetermined size comprising:

a frame;

a plurality of electrical contact elements mounted on said frame in a row configuration thereon, each of said elements having an upstanding wire-receiving portion with a slot for receiving said insulated wire and cutting through the insulation to contact the core of the wire upon said wire being received to at least a predetermined depth in said slot; and a carrier of insulative material having a row of slots for receiving said insulated wires, said carrier having retention means for holding the carrier to said frame with said slots in said carrier being aligned with said slots in said contact elements;

said carrier including a plurality of wire support projections spaced apart by the separation of said contact elements, each projection having a tip which is narrower than the outer portions of said slots in said contact elements, to enter said slots in said contact element, and each projection having a sufficient length to press one of said wires to at least said predetermined depth in a contact element slot.

3. An electrical connector comprising:

an elongated connector frame (18) of electrically insulative material having a front portion (20) for mating with another connector frame and a gear portion (22), said rear portion forming a rear wall (38) extending centrally along the length dimension of said frame, said rear wall having a row of recesses (32) on either side thereof and having a rearward surface (**38*r***);

a plurality of electrical contact elements (26) arranged in two rows and lying in said rows of recesses of said frame, each of said elements having an upstanding rearward portion (34) with a slot (36) therein, and having an extreme rearward portion bent around the frame rear wall so that the rear tip (40) of the contact element lies over said rearward surface of said frame;

an elongated cap (42) fastened to said frame and lying against said rear tips of said contact elements to hold down said elements;

a plurality of wires (14) with end portions lying in said slots of said upstanding portions of said contact elements, each wire having a central electrical conductor (56) and insulation (58) lying about the conductor, and the edges of said slots penetrating through said insulation to make electrical contact with said central conductors; and a pair of elongated, trough-shaped retainers (28, 30) constructed of electrically insulative material, each having rearward and forward side walls (52, 54) lying respectively behind and in front of said upstanding contact element portions, each side wall having a row of slots (**52*s*, 54*s***) which receive said wires to hold them in said slots of said contact elements;

each of said retainers having a resilient hook (66) at each end thereof, and said frame having a plurality of hook-receiving portions (68, 70) interlocked with said resilient hooks.

4. The electrical connector described in claim 3 wherein:

said rearward side wall (52) of each retainer has a greater width than said forward side wall (54) thereof, and said carrier is formed to leave a cutaway region (74) immediately forward of said hooks; and said frame includes a barrier (76) lying at a position forward of each of said hook-receiving portions, whereby to prevent reception of a carrier in a reversed-from-normal orientation on said frame.

5. A connector comprising:

a frame having opposite end portions and having hook engaging means at said opposite end portions;

a row of electrical contact elements mounted on said frame, each of said elements having an upstanding wire-receiving portion with a slot for receiving an insulated wire and cutting through the insulation to contact the core of the wire; and an elongated carrier of insulative material having forward and rearward walls and having hooks at either end thereof for holding the carrier to said frame with said forward and rearward walls lying respectively forward and rearward of said upstanding portions of said contact elements to aid in retaining said wires in said slots of said elements;

said hooks being located at predetermined rearward positions, and said frame including a barrier lying at a position forward of the position of said hook-engaging means, whereby to prevent reception of a carrier in a reversed-from-normal orientation on said frame.

6. A connector comprising:

a frame having mating forward portion for mating to another connector and having a rearward portion, said rearward portion having a rear wall with an element-supporting side and with a rear surface;

a plurality of elongated electrical contact elements, each element having a forward portion lying at said mating portion of said frame and retained therein, and each element having a rearward portion lying against said element-supporting side of said rear wall, the rearward portion of each element having a slotted upstanding wire-receiving portion forming a pair of legs including a forward leg connected to said forward element portion and a rearward leg;

said element having an extreme rearward part extending rearwardly from said rearward leg and around the rear end of said central wall of said frame to lie on said rear surface of said frame; and a cap lying over said rear surface of the frame and against the rearward ends of said contact elements and fastened to said frame, to hold down the extreme rearward ends of said elements, whereby to prevent prying away of the contact rear ends from the frame.

* * * * *

UNITED STATES PATENT OFFICE

CERTIFICATE OF CORRECTION

Patent No. 3,958,853 Dated May 25, 1976

Inventor(s) Robert Everett Wilson

It is certified that error appears in the above-identified patent and that said Letters Patent are hereby corrected as shown below:

Column 9, line 45; "gear" should read -- rear --.

Column 10, line 46; after "having" add -- a --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*